US011793331B2

(12) United States Patent
Skrypek

(10) Patent No.: US 11,793,331 B2
(45) Date of Patent: Oct. 24, 2023

(54) WINE RACK

(71) Applicant: Michael V. Skrypek, Brecksville, OH (US)

(72) Inventor: Michael V. Skrypek, Brecksville, OH (US)

( * ) Notice: Subject to any disclaimer, the term of this patent is extended or adjusted under 35 U.S.C. 154(b) by 0 days.

(21) Appl. No.: 17/738,098

(22) Filed: May 6, 2022

(65) Prior Publication Data

US 2022/0354276 A1 Nov. 10, 2022

Related U.S. Application Data

(60) Provisional application No. 63/185,430, filed on May 7, 2021.

(51) Int. Cl.
*A47F 7/28* (2006.01)
*A47B 73/00* (2006.01)

(52) U.S. Cl.
CPC ..... *A47F 7/28* (2013.01); *A47B 73/00* (2013.01)

(58) Field of Classification Search
CPC ..... A47F 7/28; A47F 7/281; A47B 73/00
See application file for complete search history.

(56) References Cited

U.S. PATENT DOCUMENTS 2,061,937 A * 11/1936 Fay ..... B65G 1/14 211/43
2,746,571 A * 5/1956 Taylor ..... B60T 3/00 188/32
3,591,049 A * 7/1971 Auriemma ..... A47F 1/06 221/307
4,106,735 A * 8/1978 Partain ..... B60P 7/12 410/49
4,327,836 A * 5/1982 Okuno ..... A47F 7/285 211/74
4,802,705 A * 2/1989 Elwell ..... B60R 13/01 29/428
5,088,139 A * 2/1992 Bloom ..... A47D 13/08 190/1
5,128,189 A * 7/1992 Bartlett ..... B32B 27/36 428/81
D365,732 S * 1/1996 Kellen ..... D7/701
6,454,108 B1 * 9/2002 Gerard ..... A47F 7/283 211/74
7,357,270 B2 * 4/2008 Mayrose ..... A47F 7/28 248/346.11
8,910,805 B2 * 12/2014 Gregory ..... A47B 47/00 211/187

(Continued)

FOREIGN PATENT DOCUMENTS

GB 2158705 A * 11/1985 ..... A47B 73/00
GB 2423703 A * 9/2006 ..... A47B 73/00
WO WO-2011092114 A1 * 8/2011 ..... A47B 73/00

*Primary Examiner* — Stanton L Krycinski
(74) *Attorney, Agent, or Firm* — Tucker Ellis LLP

(57) ABSTRACT

Provided is a wine rack having a mat, a first side wall, and a second side wall. The wine rack is configured to support a plurality of wine bottles between the first side wall and the second side wall. The wine rack is further configured to roll into a stowed position for storage, transportation, distribution, or advertising. Alternatively, the wine rack has a pair of scissor arms located between the first side wall and the second side wall such that the rack is configured to pivot between an extended position and a retracted position.

18 Claims, 18 Drawing Sheets

(56) References Cited

U.S. PATENT DOCUMENTS

| | | | | |
|---|---|---|---|---|
| 9,445,669 | B2 * | 9/2016 | Li | A47B 96/021 |
| 2013/0270206 | A1 * | 10/2013 | Peck | A47B 73/00 211/75 |
| 2014/0284289 | A1 * | 9/2014 | Perez | A47B 73/00 211/49.1 |
| 2017/0303698 | A1 * | 10/2017 | Howie | A47C 7/021 |
| 2020/0391902 | A1 * | 12/2020 | Valencia | B65D 5/5035 |

* cited by examiner

WINE RACK

FIELD OF INVENTION

The present invention relates generally to storage racks or display racks for containers, and more specifically, storage racks or display racks for wine bottles.

BACKGROUND

Various types of devices or storage racks can be provided for wine bottles or similar containers for storage or display purposes.

SUMMARY OF INVENTION

The present application provides embodiments of a light weight and foldable wine rack for wine bottles. The wine rack has a main body portion having first end and a second end. The first and the second end include a first side wall and a second side wall affixed to each respective end. The wine rack is configured to support a plurality of wine bottles between the first side wall and the second side wall. The wine rack is light weight and flexible such that the wine rack can be folded or rolled for convenience, storage, transportation, distribution, or advertising.

Although the present application describes the rack as storing or displaying wine bottles, it should be appreciated that the rack may be used to store any suitable bottle, can, container, or the like.

According to an aspect, a rack for supporting a plurality of cylindrical containers, the rack comprises a mat formed from a flexible material and having a first end and a second end, a first elongate side wall having a first end and a second end, the first elongate side wall being affixed to the first end of the mat along a width of the mat, and a second elongate side wall having a first end and a second end, the second elongate side wall being affixed to the second end of the mat along the width of the mat, wherein the rack is configured to support a plurality of cylindrical containers on a top of the mat between the first elongate side wall and the second elongate side wall.

According to an aspect, a rack for supporting a plurality of cylindrical containers, the rack comprises a first side wall, a second side wall, a first elongate arm having a first end and a second end, the first end rotatably attached to the first side wall and the second end rotatably attached to the second side wall, and a second elongate arm having a first end and a second end, the first end rotatably attached to the first side wall and the second end rotatably attached to the second side wall, wherein the first elongate arm and the second elongate arm cross at a location between the first side wall and the second side wall, wherein the rack is configured to support a plurality of cylindrical containers on top of the first and the second elongate arms and between the first side wall and the second side wall.

According to an aspect, a rack for supporting a plurality of cylindrical containers, the rack comprises a mat formed from a flexible material and having a first end and a second end, a first elongate side wall having a first end, a second end, and a cove extending along a length of the first elongate side wall from the first end to the second end, the first elongate side wall being affixed to the first end of the mat along a width of the mat, and a second elongate side wall having a first end, a second end, and a cove extending along a length of the second elongate side wall from the first end to the second end, the second elongate side wall being affixed to the second end of the mat along the width of the mat, wherein the rack is configured to support a plurality of cylindrical containers on a top of the mat between the first elongate side wall and the second elongate side wall, and wherein the rack is configured to be rolled into a stowed position and unrolled into an unstowed position.

According to an aspect, a rack for supporting a plurality of cylindrical containers comprises a first side wall, a second side wall, a pair of scissor arms located between the first side wall and the second side wall such that the rack is configured to pivot between an extended position and a retracted position, wherein the pair of scissor arms are pivotably connected to one another about a central axis located between a respective first and second end of the pair of scissor arms, the rack configured to support the plurality of cylindrical containers on top of the pair of scissor arms and between the first side wall and the second side wall.

According to an aspect, the first and second side walls are at a greater distance from one another in the extended position than in the retracted position. According to an aspect, the rack of claim 19, wherein, in the retracted position, the first side wall and the second side wall are substantially parallel to and substantially co-linear with one another.

The foregoing and other features of the application are described below with reference to the drawings.

DETAILED DESCRIPTION

Wine bottles can be stored or displayed in a variety of configurations and orientations. In some settings, such as in retail stores, wine bottles can be stored and displayed vertically by standing the wine bottles on a shelf with the top and/or cork facing upwards. Storing wine bottles vertically, however, can tend to dry out the corks of wine bottles, especially for wine bottles that utilize natural cork. In some circumstances, the shelf life of wine can be extended by storing wine bottles horizontally rather than vertically. For example, wine bottles having traditional corks may benefit from horizontal storage because the cork can be kept moist by the wine touching the cork in the bottle. Conversely, while in a vertical orientation, wine from within the wine bottle may not reach the cork (e.g., a pocket of air is common at the top of a wine bottle). Provided herein is a foldable wine rack that is configured to store a plurality of wine bottles in a horizontal orientation. The wine rack can unfold onto a surface, and a plurality of wine bottles can be stacked upon the wine rack for storage or display purposes. The wine rack can be low profile, light weight, easily packed away, and rolled into a stowed configuration for movement or storage. The wine rack can then be unrolled from the stowed configuration to the un-rolled configuration for storing wine bottles.

Figure 1:
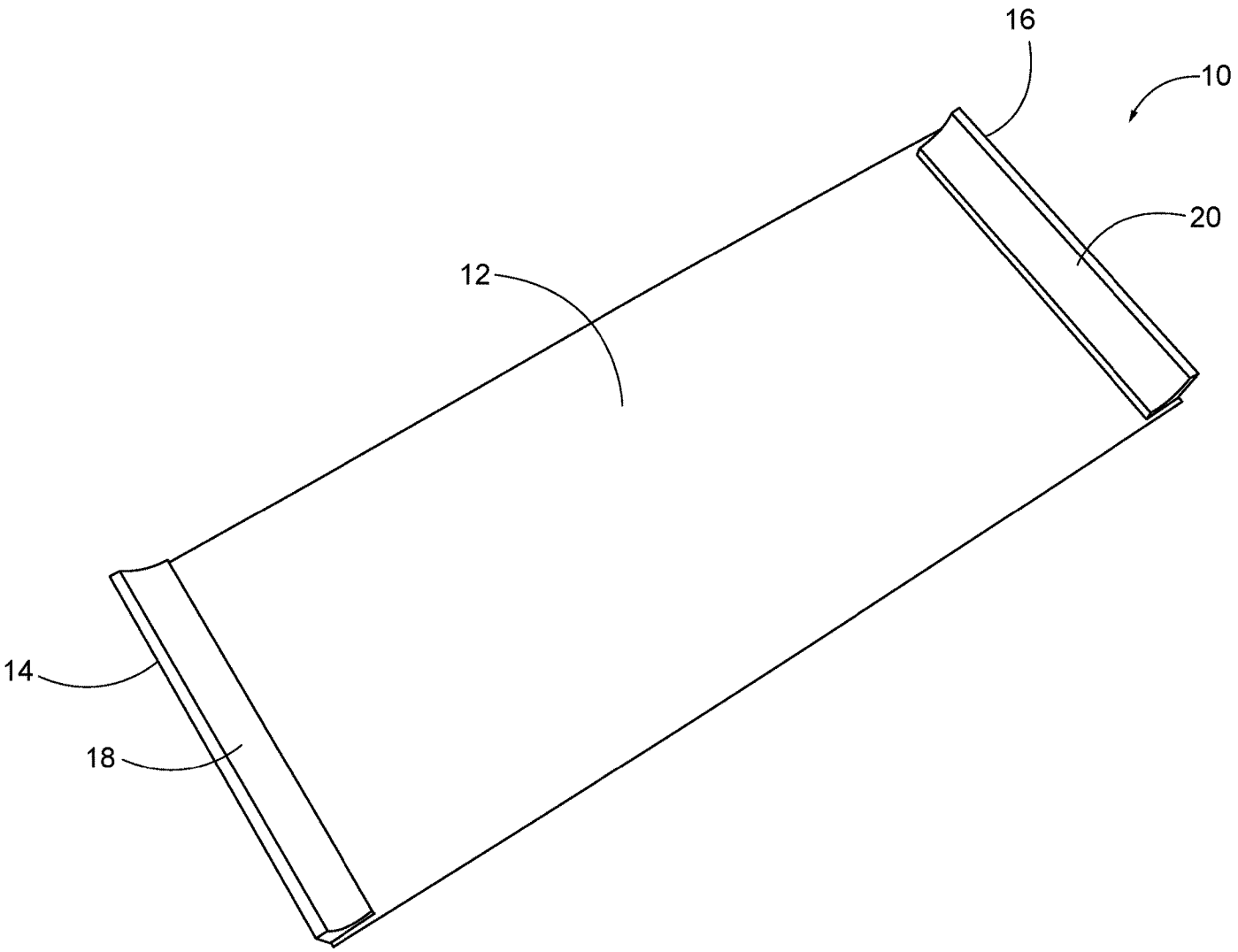
FIG. 1 is a perspective view of an exemplary embodiment of a wine rack.
Figure 2:
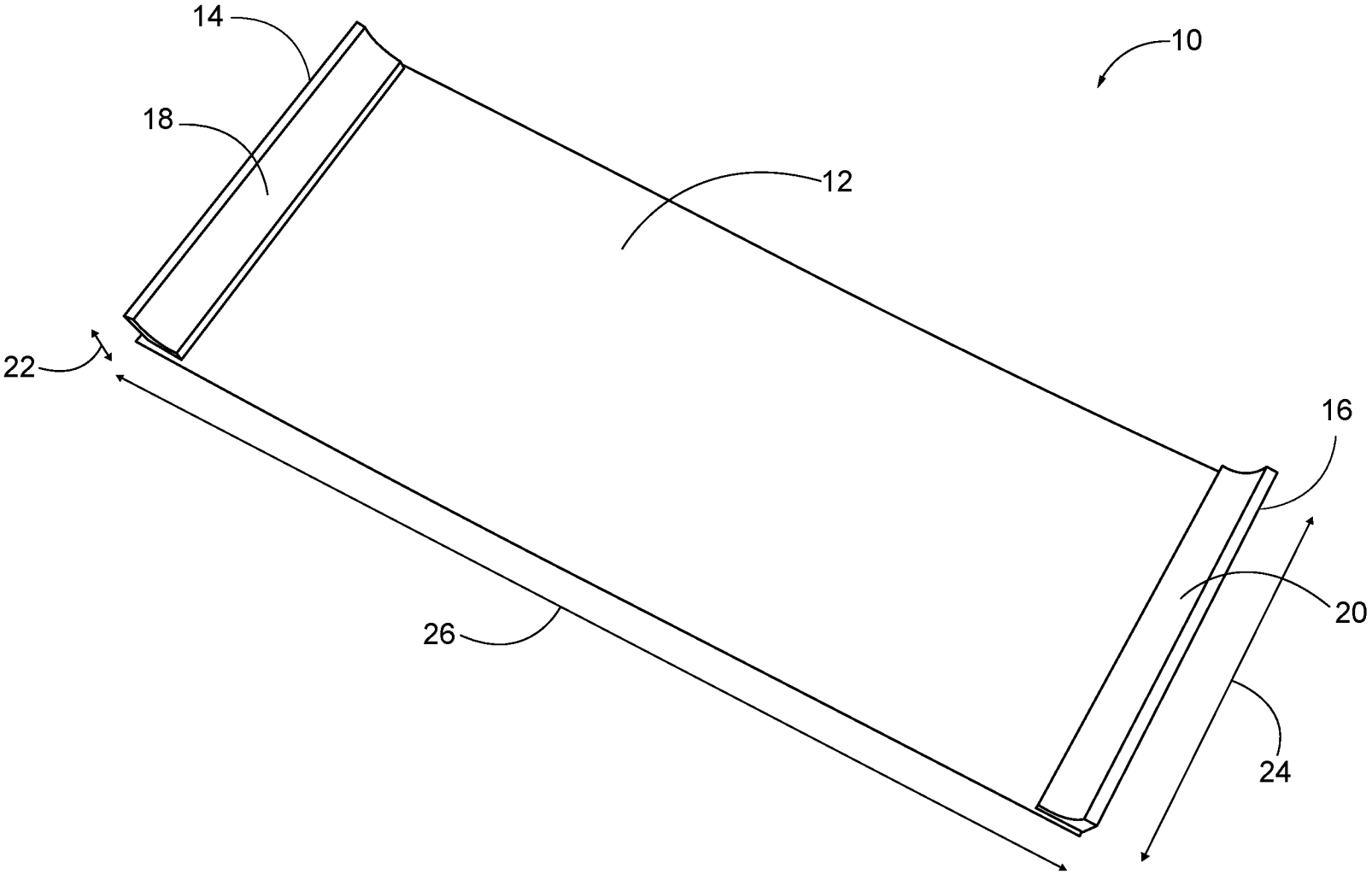
FIG. 2 is another perspective view of the wine rack.

Referring initially to FIGS. 1 and 2, an exemplary container rack (also known as a wine rack, storage rack, display rack, keeper, display, etc.) is shown generally at reference numeral 10. The container rack 10, is herein described as a wine rack, however, it is to be appreciated that the container rack may be applicable to other suitable uses, such as for storing/supporting other containers such as soda cans, beer bottles, food cans, or the like. FIGS. 1 and 2 illustrate the wine rack 10 in a fully extended, un-stowed, or unrolled configuration.

The wine rack 10 includes a base or mat 12 having a first end 14 and a second end 16, a first elongated/elongate side wall 18 affixed to the mat 12 at the first end 14, and a second elongated/elongate side wall 20 affixed to the mat 12 at the second end 16. The wine rack 10 can be configured to hold a number of wine bottles on top of the mat 12 between the first side wall 18 and the second side wall 20, and may have any suitable dimensions. For example, as shown in FIG. 2, the wine rack 10 can have a length 26, a width 24, and a height 22. The width 24 of the wine rack 10 can correspond to a width of the mat 12 or a width of the first and second side walls 18 and 20 from end to end. The width of the first and second side walls 18 and 20 can be substantially the same as the width of the mat 12, and thus, substantially equal to the total width 24 of the wine rack 10. It should be appreciated that the width of the side walls 18 and 20 can be less than the width of the mat 12 (as illustrated in FIGS. 1 and 2), or in other embodiments, the width of the side walls 18 and 20 can be substantially the same as the width of the mat 12 as described above. Moreover, the width 24 of the wine rack 10 can be configured to accommodate any suitable container. For example, the width 24 of the wine rack 10 can be a first width to store wine bottles or a second width, less than the first width, to store soda cans.

Similarly, the length 26 of the wine rack 10 can be configured to accommodate any number of wine bottles. For example, the length 26 can be increased to accommodate a greater number of wine bottles or the length 26 can be decreased to accommodate less wine bottles. The wine bottles can extend along the width 24 of the wine rack 10 from the first side wall 18 to the second side wall 20. The length 26 can be configured such that there is no gap between the wine bottles to produce a tight fit (e.g., no gap between wine bottles). Alternatively, the length 26 can be configured such that there is a small gap between the wine bottles. A small gap between the wine bottles can allow for stability and easier placement or removal of wine bottles. A small gap between bottles can also allow the wine rack 10 to be used with wine bottles of various sizes and diameters. For example, a small gap can allow wine bottles of various diameters to fit between the first and second side walls 18 and 20 without overcrowding. In an embodiment, the wine rack 10 can have a length of approximately fifteen inches, a width of approximately six inches, and a height of approximately three quarters of an inch. It should be appreciated, however, that the wine rack 10 can be configured with any suitable dimensions according to the desired use or size of wine bottles or other suitable containers. The dimensions of the wine rack 10 can further be configured to accommodate any desired number of wine bottles or suitable containers.

Figure 3:
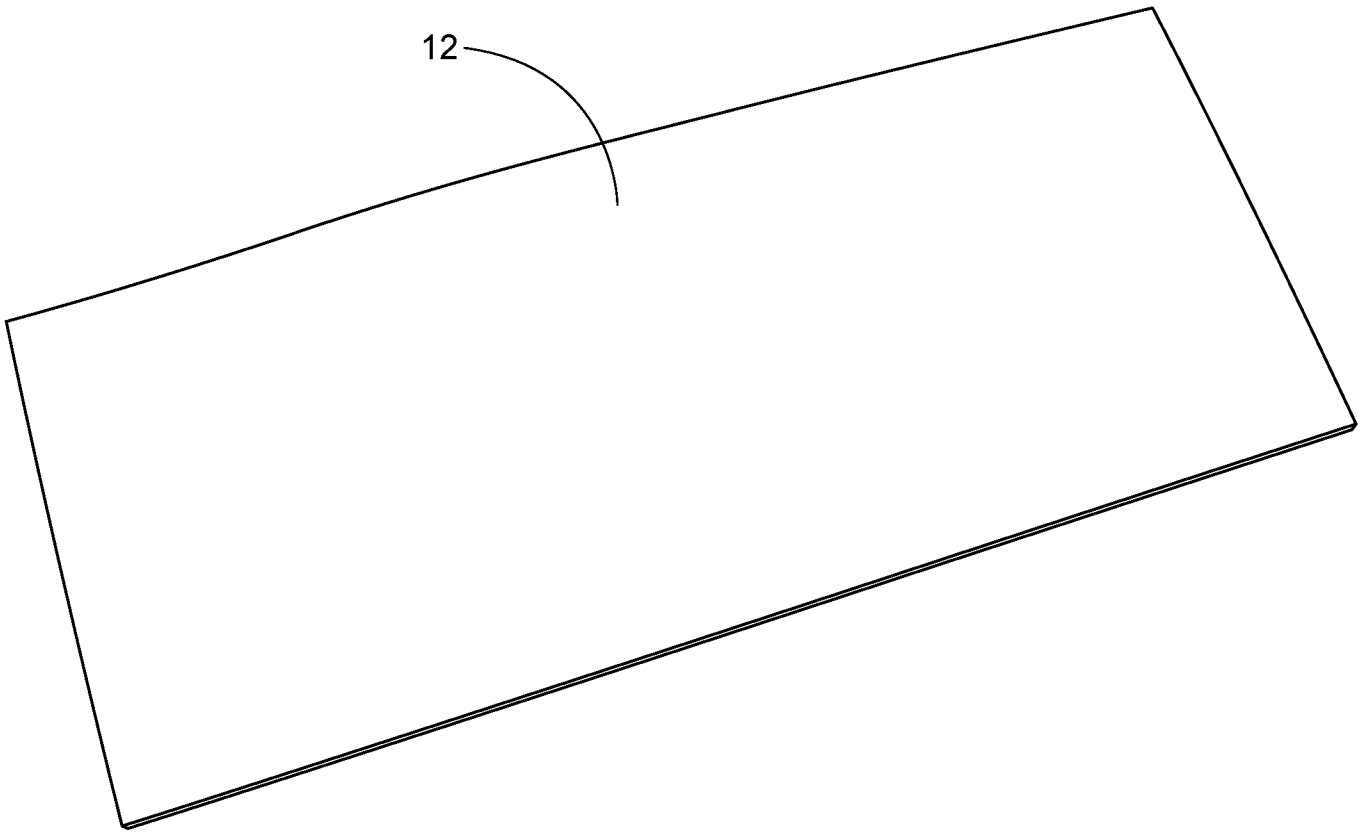
FIG. 3 is a perspective view of an exemplary embodiment of a mat for the wine rack.
Figure 4:
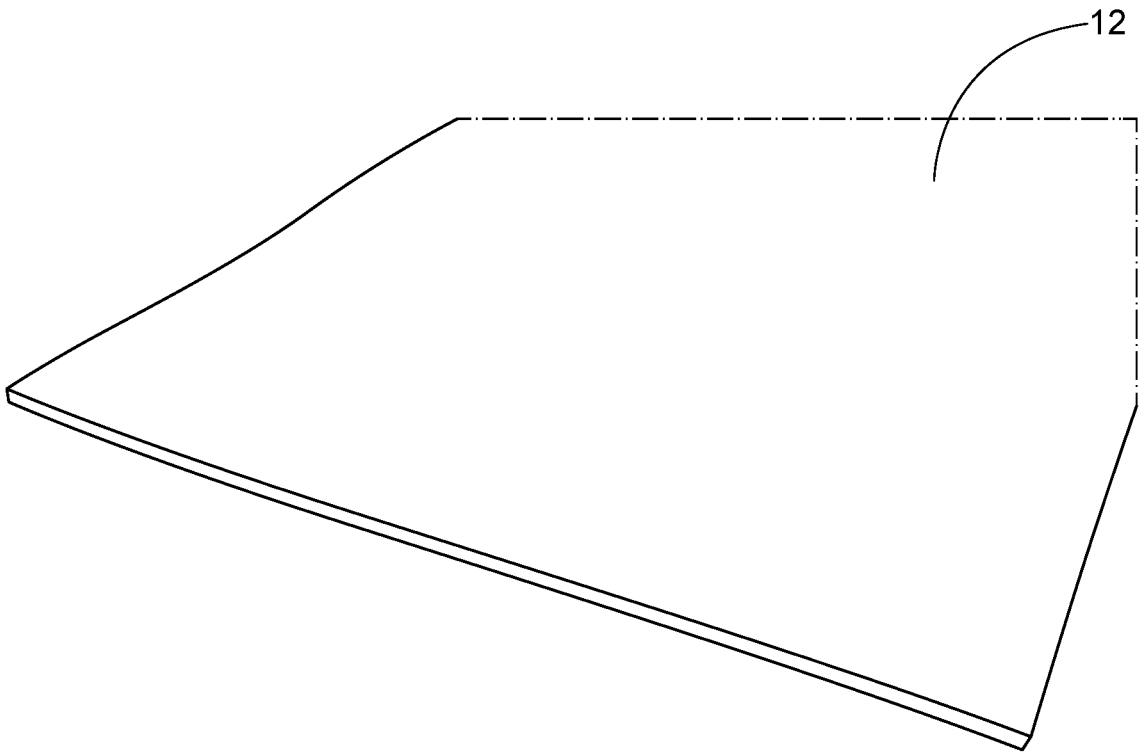
FIG. 4 is another perspective view of the mat for the wine rack.
Figure 5:
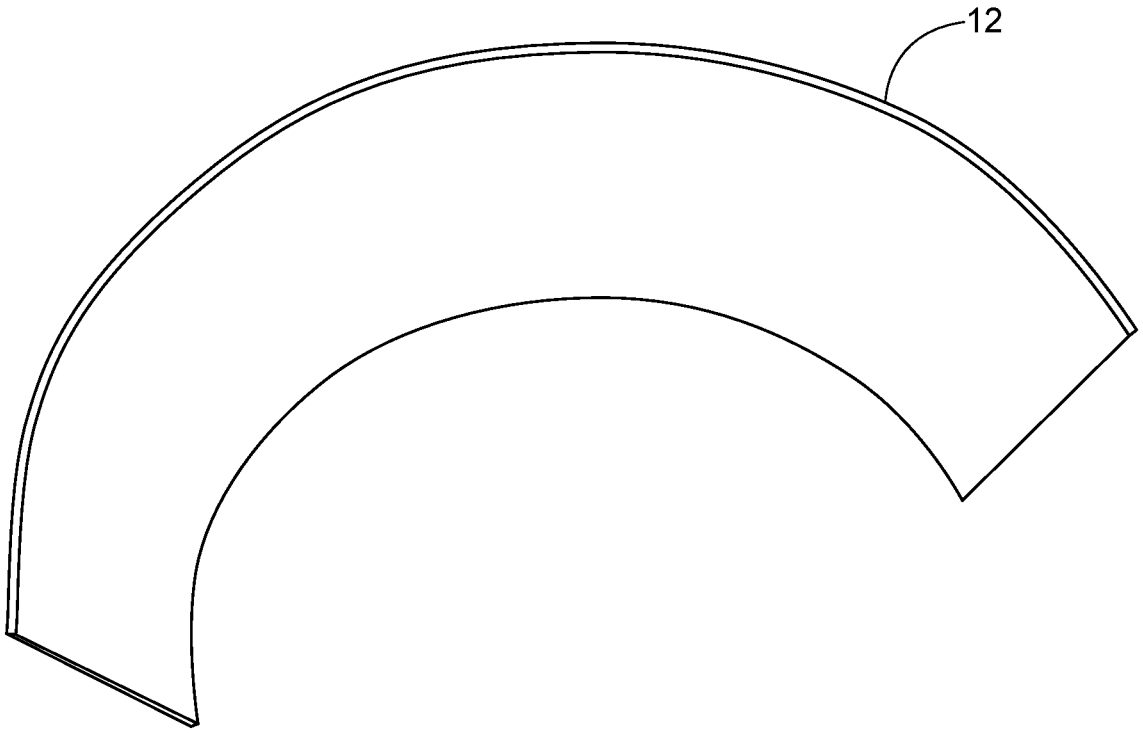
FIG. 5 is another perspective view of the mat for the wine rack shown in a partially rolled configuration.

Turning to FIGS. 3-5, the mat 12 will be described in detail. The mat 12 can be manufacturing from a malleable, foldable, and otherwise flexible material. In this regard, FIG. 5 illustrates the mat 12 in a partially rolled or flexed position. The mat 12 can be formed of any suitable material such as, but not limited to, ethylene-vinyl acetate, neoprene, polychloroprene, natural rubber, styrene-butadiene, butyl, nitrile, ethylene propylene, silicone, viton, polyurethane, vinyl, felt, fabric, mineral wool, or the like. In an example, an ethylene-vinyl acetate closed cell foam can be used having a surface that can compress when force is applied and can return to an initial form when the force is removed. In this manner, the material can be molded and shaped with a heat source, for example. In other embodiments, the mat 12 can be formed from a substantially flat and non-flexible material such as, but not limited to, wood, metal, steel, aluminum, plastic, polycarbonate, polyvinyl chloride, polyethylene, polypropylene, carbon fiber, or other similar materials.

Figure 7:
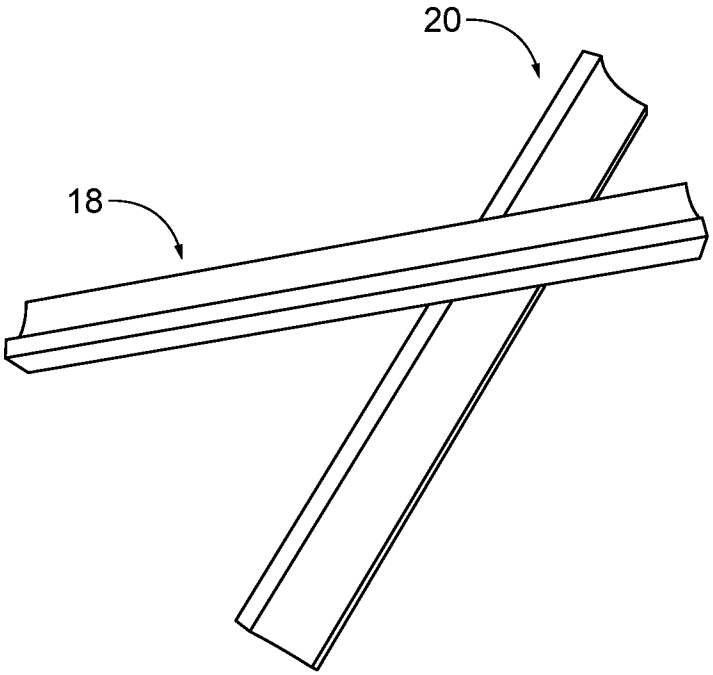
FIG. 7 is another perspective view of the pair of side walls for the wine rack.
Figure 6:
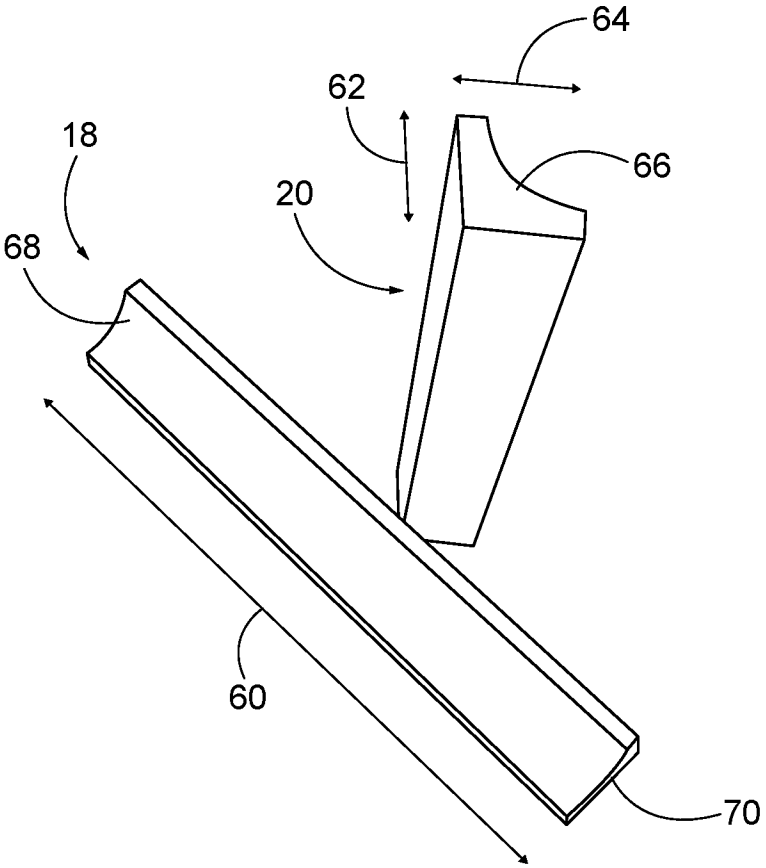
FIG. 6 is a perspective view of a pair of side walls for the wine rack.

Turning to FIGS. 6 and 7, the side walls 18 and 20 will be described in detail. The first and second side walls 18 and 20 can be formed of any suitable material such as, but not limited to, wood, metal, steel, aluminum, plastic, polycarbonate, polyvinyl chloride, polyethylene, polypropylene, carbon fiber, or the like. The first side wall 18 and the second side wall 20 can further be coated with a suitable outer covering such as an epoxy paint primer, such as an all-in-one paint and primer. In some embodiments, the outer covering can be a color of choosing (e.g., red, blue, black, white, etc.). It should be appreciated that the outer covering of the first side wall 18 and the second side wall 20 can be any suitable material such as rubber, plastic, vinyl, or the like. In other embodiments, the first and the second side walls 18, 20 may be free from an outer covering. In these embodiments, the first and second side walls 18, 20 can be finished with a paint, stain, or similar treatments.

The side walls 18 and 20 can be cut or molded into a substantially triangular profile having a length 60, a first width 62, and a second width 64. The side walls 18 and 20 can further include a bevel or a cove 66 at the hypotenuse. The cove 66 can extend along the length 60 of the side walls 18, 20 from the first end 68 to the second end 70. It is to be appreciated that the dimensions of the side walls 18 and 20 can be configured according to sound engineering judgment. In an example, the dimensions of the side walls 18 and 20 can be configured according the dimensions of the mat 12 or dimensions of desired containers (e.g., wine bottles). In other examples, the cove 66 can include a radius that substantially corresponds to a radius of a cylindrical container such as a wine bottle. Yet in other examples, the radius can be greater than or smaller than the radius of a cylindrical container.

In an embodiment, each side wall 18 and 20 can include a base portion extending along the first width 62 of each side wall 18 and 20. The base portion being affixed to the mat 12. Each side wall 18 and 20 can further include a support portion extending upward from the base portion along the second width 64 of each side wall 18 and 20. The cove 66 can extend along the length 60 of each side wall 18 and 20 from a top of the support portion towards the base portion.

In an embodiment, to accommodate wine bottles, the length 60 of the side walls 18 and 20 can be six inches, the first width 62 and the second width 64 can be three quarters of an inch, and the radius of the cove 66 can be approximately one inch. It should be appreciated, however, that the dimensions of the side walls 18 and 20 can be any suitable dimension without deviating from the scope of the application.

Figure 8:
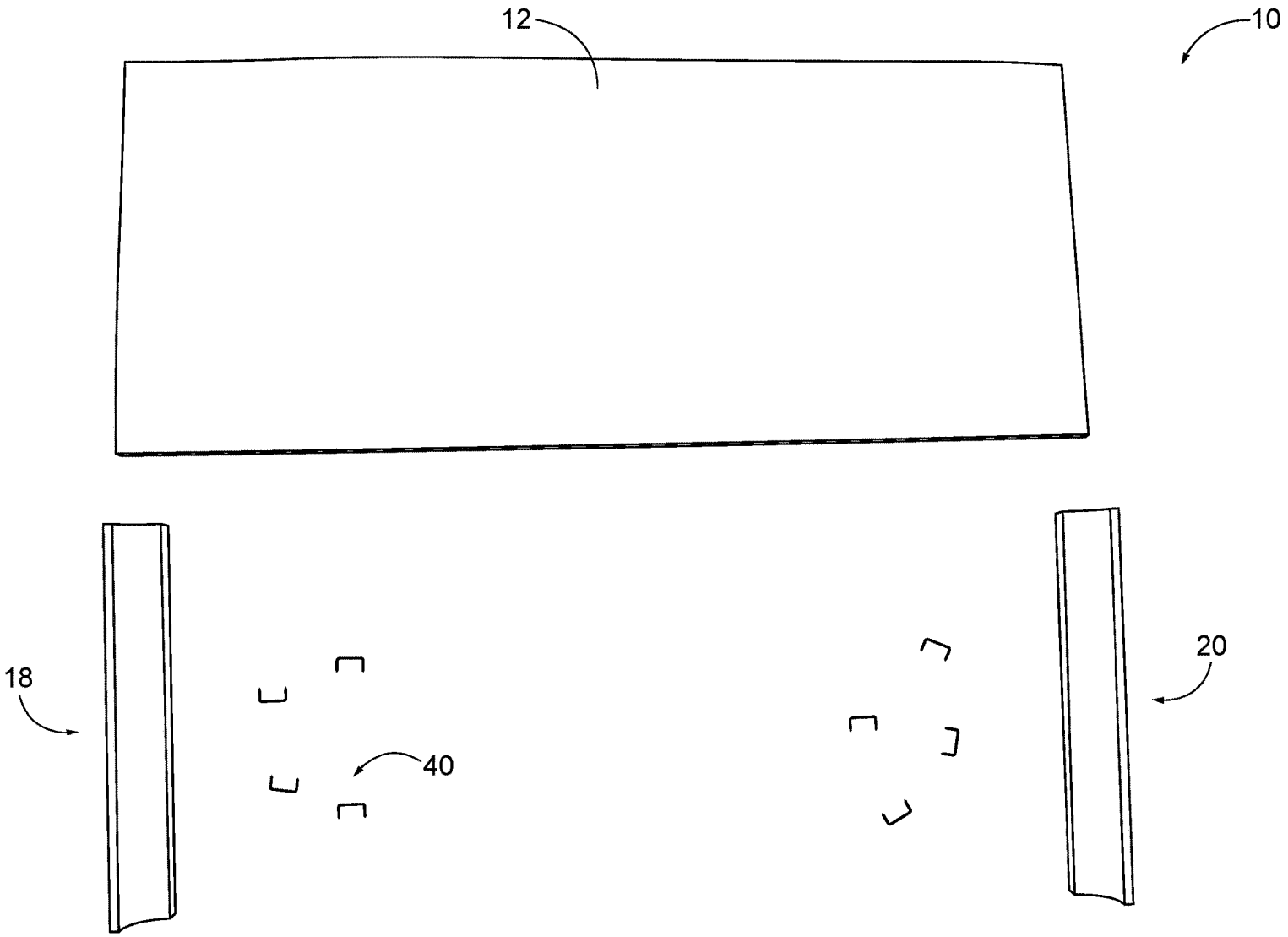
FIG. 8 is a top perspective view of an exemplary embodiment of the wine rack shown in a disassembled state.

Turning to FIG. 8, the wine rack 10 is shown in a disassembled configuration. In the embodiment, the wine rack 10 includes the mat 12 formed of a suitable flexible material, such as neoprene, and the first side wall 18 and second side 20 wall formed of a suitable rigid material, such as wood. The first and second side wall 18, 20 can be affixed to the mat 12 by fasteners 40, such as steel staples. It should be appreciated, however, that the first and second side walls 18, 20 can be affixed to the mat 12 in any suitable manner such as with an adhesive, chemical adhesive (e.g., polyurethane construction adhesive), nails, screws, hook and anchors, glue, thread, or the like. Yet, in other embodiments, the mat 12 and the side walls 18, 20 can be formed or manufactured as a one-piece product.

In an embodiment, commercial grade steel staples can be applied to the back of the mat 12 and inserted through the mat 12 into the bottom of the first and the second side walls 18 and 20. The staple size can be a five sixteenths inch depth and eight millimeter length staple. A suitable number of fasteners may be used, such as approximately four to six fasteners applied to secure the mat 12 to each side wall 18, 20. It should be appreciated, however, that the size and number of fasteners can vary according to professional judgment and/or size of the wine rack 10.

Figure 9:
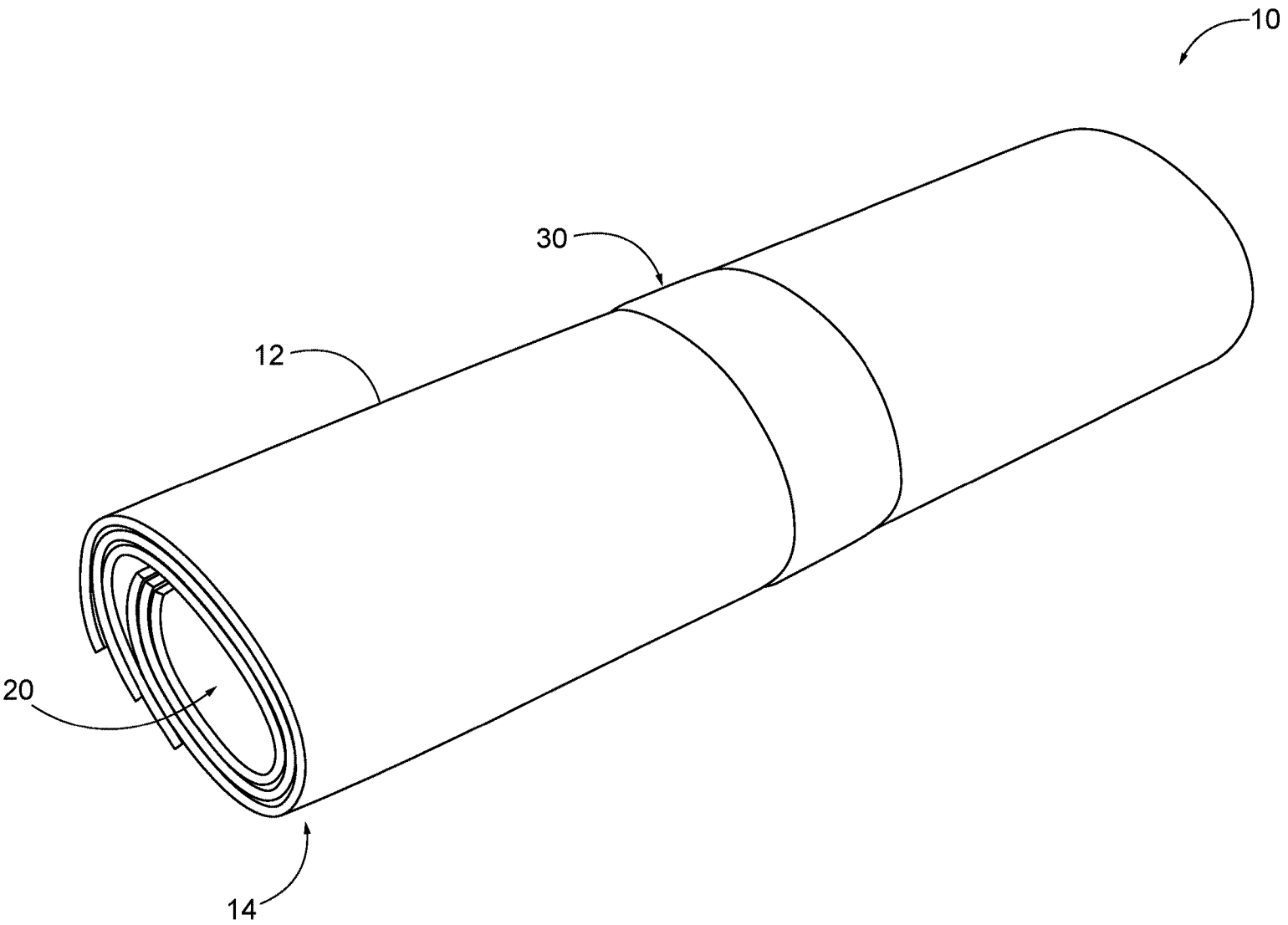
FIG. 9 a perspective view of the wine rack shown in a rolled configuration.

Turning to FIG. 9, the wine rack 10 is shown in a rolled/stowed configuration. It should be appreciated that the mat 12 can be sufficiently flexible to allow the wine rack 10 to be rolled as shown. The wine rack 10 can be rolled around either the first side wall 18 or the second side wall 20. The wine rack 10 can further include a strap or band 30 to hold the wine rack 10 in a rolled configuration for convenience, storage, packaging, shipping, etc. The strap 30 can be removeably attached to the wine rack 10 such that a user can reuse the strap 30 each time the wine rack 10 is rolled or unrolled. In some embodiments, the wine rack 10 can include a latch or hook in addition to, or in the alternative to, the strap 30 to hold the wine rack 10 in a rolled or a stowed position. It should be appreciated that the strap 30 can then be removed from the wine rack 10 such that the wine rack 10 can be unrolled into an extended or unrolled configuration for storing wine bottles.

Figure 10:
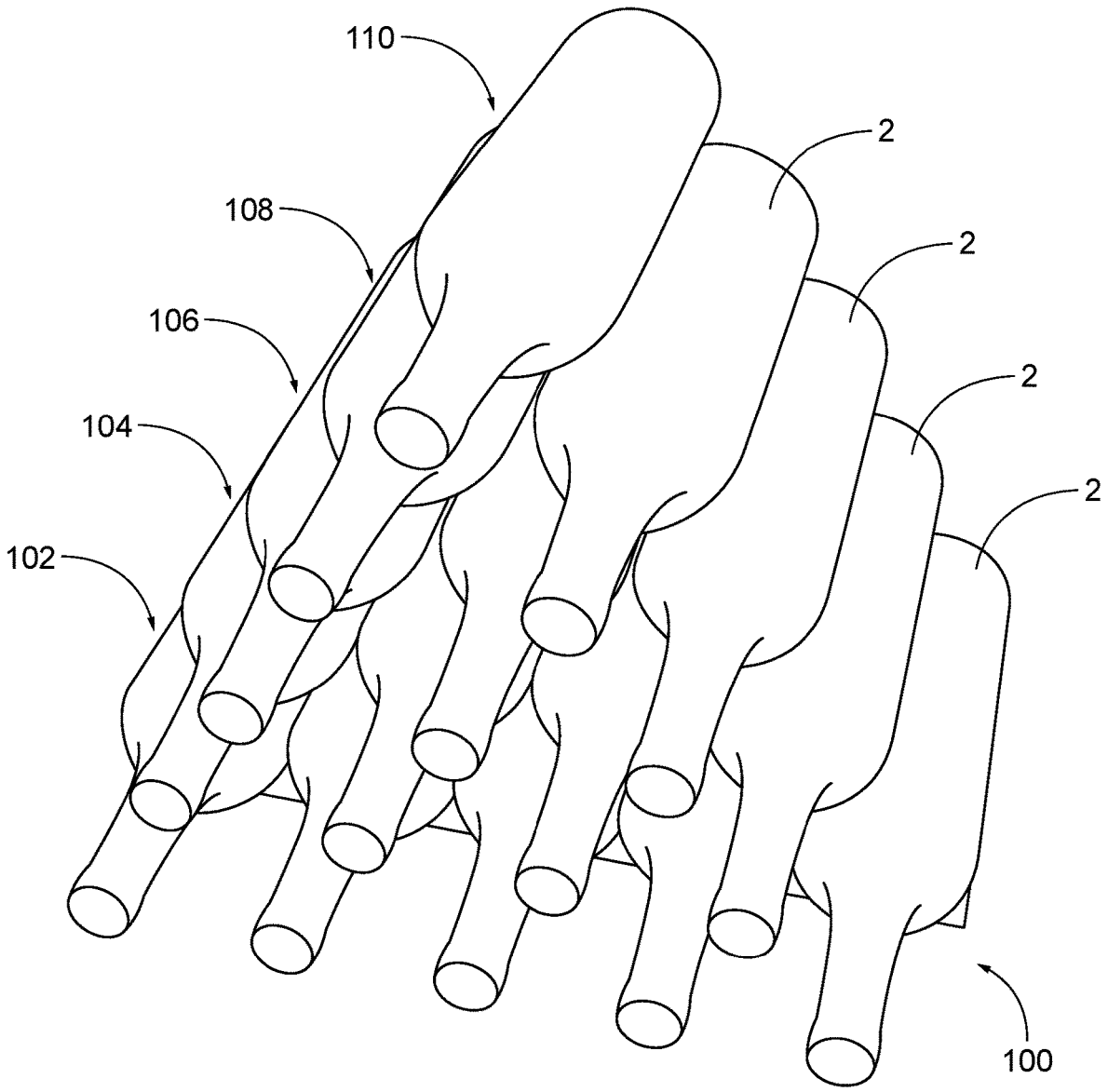
FIG. 10 is a perspective view of another exemplary embodiment of a wine rack configured to hold 15 wine bottles.

Turning to FIG. 10, a wine rack configured to hold fifteen wine bottles 2 is shown generally at reference numeral 100. The first layer 102 (the bottom layer) of wine bottles 2 consists of five wine bottles 2 positioned from the first side wall to the second side wall of the wine rack 100. As illustrated, the wine bottles 2 of the first layer 102 are oriented horizontally such that the cylindrical body of the wine bottle 2 rests on the mat 12. The second layer 104 consists of four wine bottles 2, the third layer 106 consists of three wine bottles 2, the fourth layer 108 consists of two wine bottles 2 and the fifth layer 110 (the top layer) consists of one wine bottle 2. The wine bottles 2 of each respective layer are oriented horizontally such that the cylindrical body of the wine bottle 2 rests on the cylindrical body of the wine bottles 2 on the layer below. In total, the wine rack 100 can hold fifteen wine bottles 2. In other embodiments, the wine rack 100 may hold more than or less than fifteen wine bottles 2 depending on an outer diameter of the wine bottles 2, for example.

Figure 11:
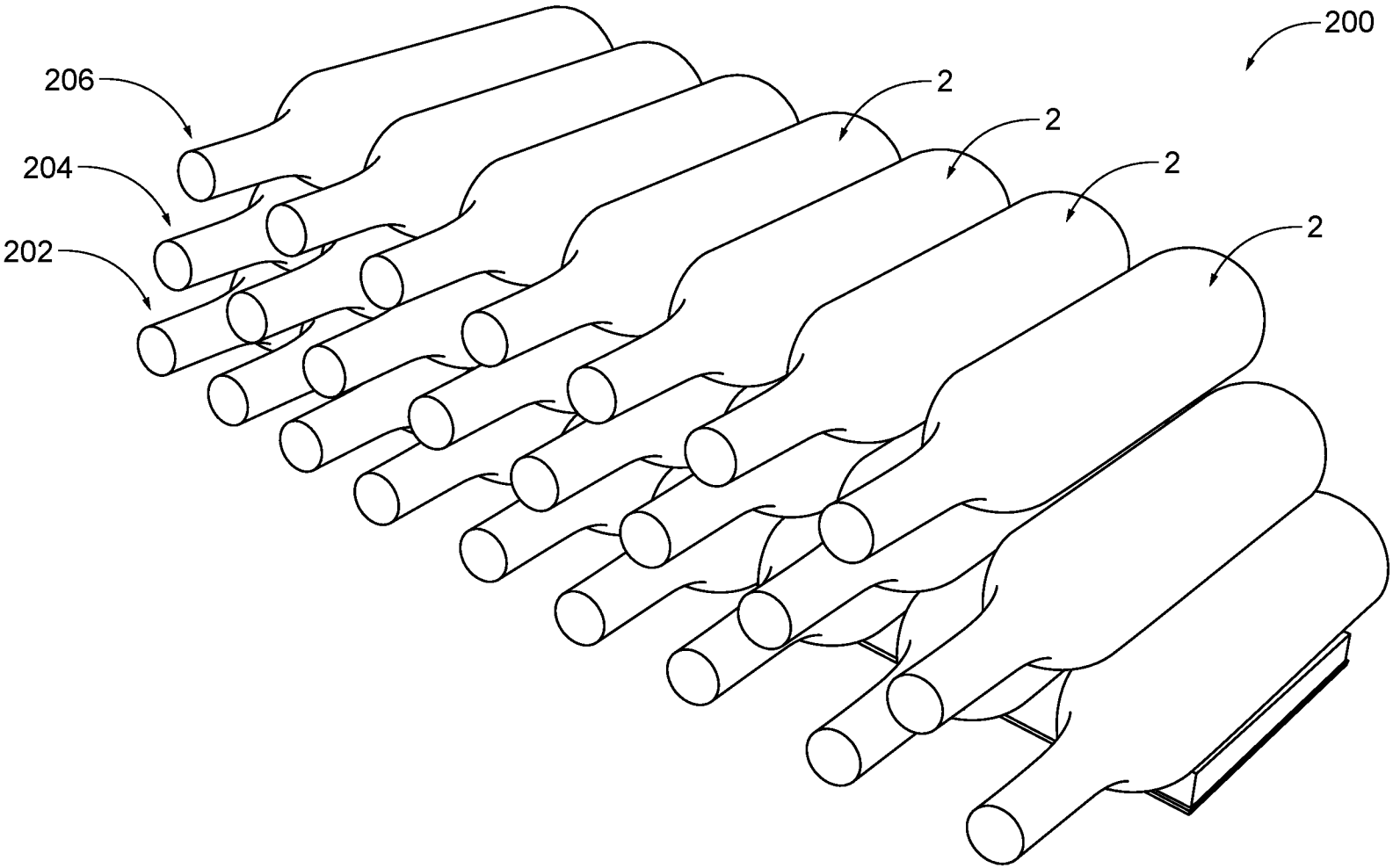
FIG. 11 is a side perspective view of another exemplary embodiment of a first wine rack and a second wine rack positioned adjacent one another.
Figure 12:
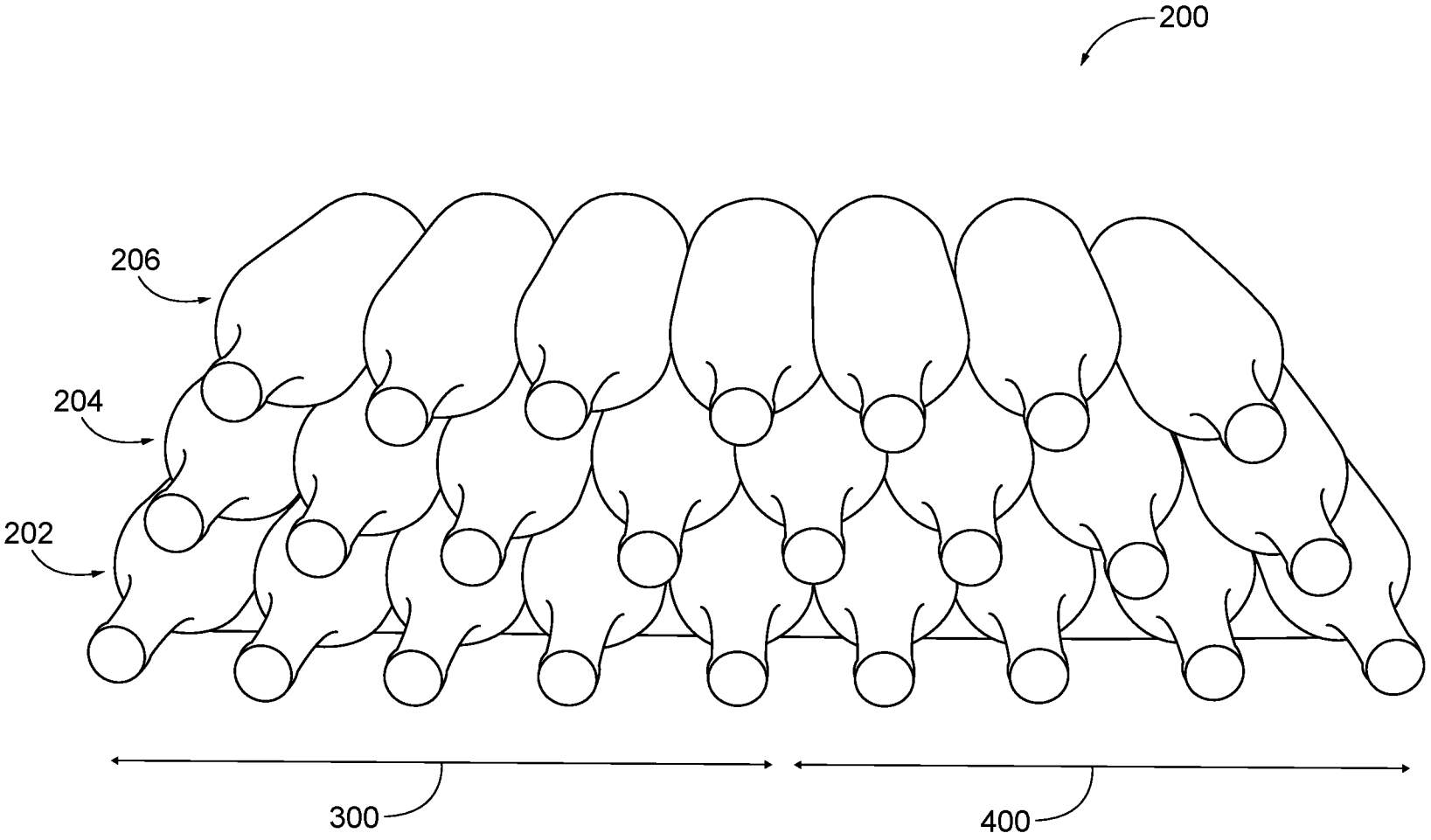
FIG. 12 is a front perspective view of the first wine rack and the second wine rack positioned adjacent one another.

Turning to FIGS. 11 and 12, a configuration 200 is shown in which a first wine rack 300 and a second wine 400 rack are placed adjacent to each other to hold a plurality of wine bottles 2. The first wine rack 300 and the second wine rack 400 can be held together by frictional forces acting between the mats 12 and the surface on which the wine racks 300, 400 are placed. In configuration 200, the first wine rack 300 is a wine rack configured to hold fifteen wine bottles 2 (or five wine bottles on the first layer 202) an the second wine rack 400 is a wine rack configured to hold ten wine bottles 2 (or four wine bottles on the first layer 202). When placed next to one another, the wine rack 300 and the wine rack 400 can support nine wine bottles 2 on a first layer (e.g., five bottles with the first wine rack 300 and four bottles with the second wine rack 400) and twenty-four wine bottles 2 across three layers 202, 204, 206 of wine bottles 2.

It should be appreciated, however, that any number of wine racks (of any dimensions or capacities) may be used in conjunction with one another. Different numbers of wine bottles 2 can be displayed or stored by orienting the bottles in a desired manner using a preferred number of wine bottles and/or layers of wine bottles. For instance, although configuration 200 is shown with twenty-four bottles of wine, it should be appreciated that configuration 200 can hold a maximum of forty-five bottles across nine layers.

Figure 13:
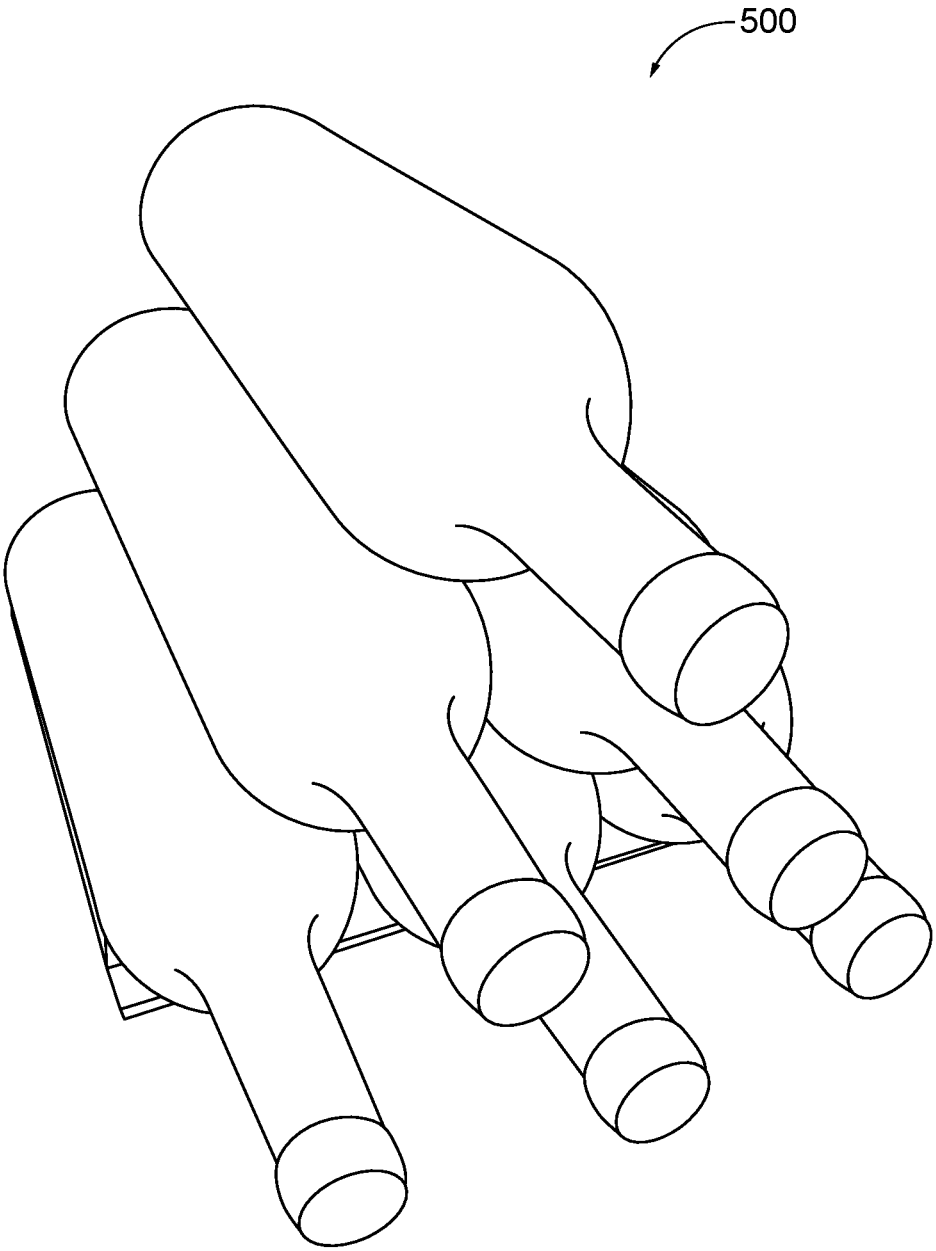
FIG. 13 is a perspective view of another exemplary embodiment of a wine rack configured to hold 6 wine bottles.
Figure 14:
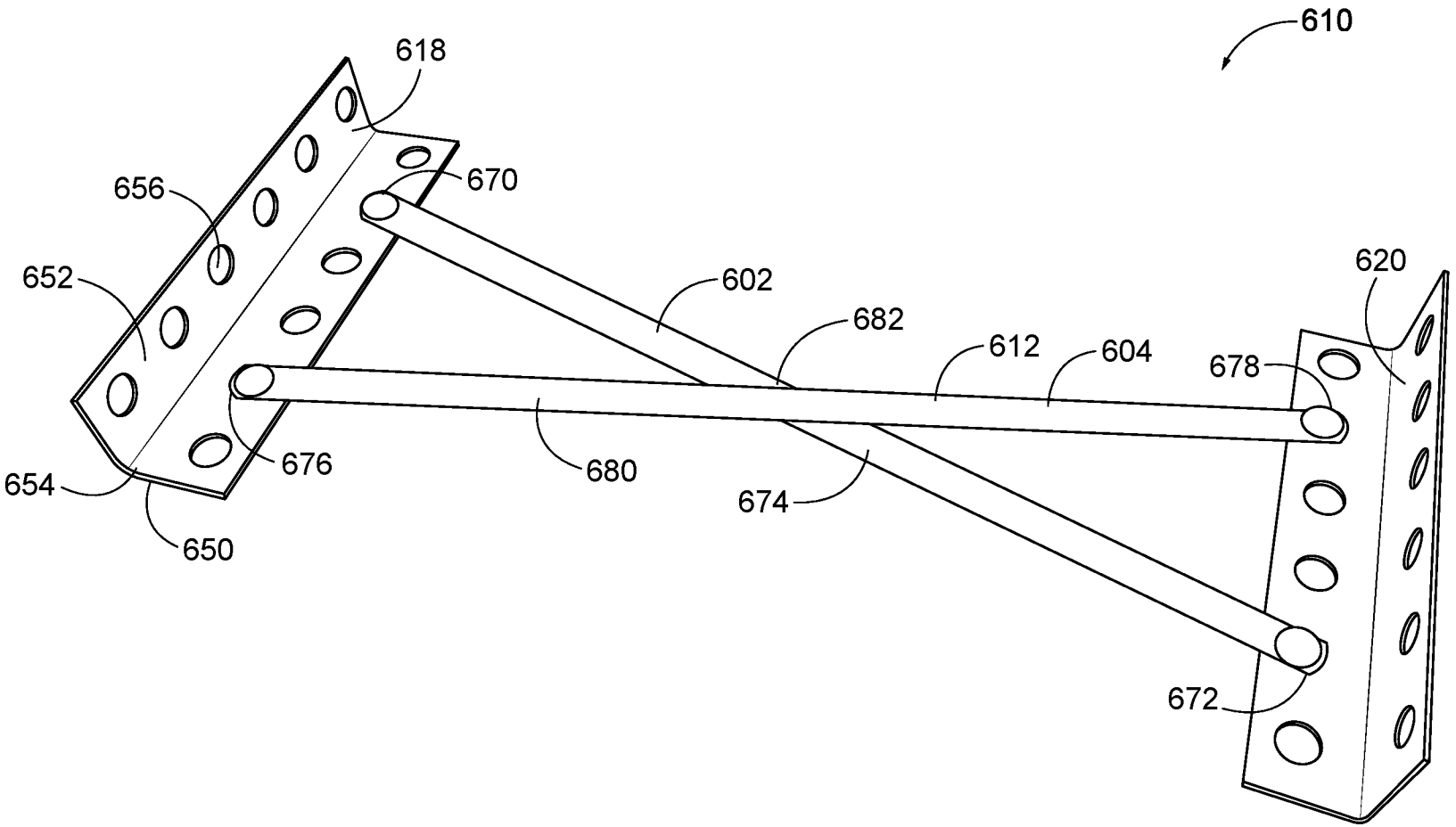
FIG. 14 is a side perspective view of another exemplary embodiment of a wine rack.

Turing to FIGS. 13 and 14, a wine rack 500 configured to hold six bottles of wine is shown. In an example, the wine rack 500 is a suitable size such that the wine rack 500 can fold around the diameter of one wine bottle. By folding the wine rack 500 around a wine bottle, the wine rack 500 and the wine bottle can be sold, marketed, and/or transported together.

Turning to FIGS. 14-19, another exemplary embodiment of a wine rack is shown generally at 610. The wine rack 610 is substantially the same as the above-referenced wine rack 10, and consequently the same reference numerals but indexed by 600 are used to denote structures corresponding to similar structures in the wine racks. The foregoing description of the wine rack 10 is equally applicable to the wine rack 610 except as noted below.

The wine rack 610 includes a first side wall 618, a second side wall 620, and at least one elongated arm 602 extending from the first side wall 618 to the second side wall 620. The at least one elongated arm 602 connects the first side wall 618 and the second side wall 620 to form a surface 612 for a plurality of wine bottles to rest. Similar to wine rack 10, wine bottles may be stored or displayed using the wine rack 610 such that wine bottles are held in place between a portion of the first side wall 618 and a portion of the second side wall 620. The wine bottles rest on the surface 612 formed from the at least one elongated arm 602. It should be appreciated that the wine rack 600 can be configured with any suitable number of elongated arms 602 that extend from the first side wall 618 to the second side wall 620.

The first side wall 618 and the second side wall 620 can be any suitable dimension or shape. In the embodiment illustrated in FIGS. 14-19, the first side wall 618 and the second side wall 620 include a first portion 650 and a second portion 652. The first portion 650 is oriented adjacent to and substantially perpendicular to the second portion 652. The second portion 652 is attached to the first portion 650 along a corresponding edge 654 of the side wall 618 or 620. The first portion 650 and the second portion 654 can include a plurality of throughpassages 656 extending through the respective surfaces.

As illustrated in FIGS. 14-19, the wine rack 610 includes a first elongated arm 602 and a second elongated arm 604. The first elongated arm 602 includes a first end 670, a second end 672, and an elongated body 674 extending from the first end 670 to the second end 672. Similarly, the second elongated arm 604 includes a first end 676, a second end 678, and an elongated body 680 extending from the first end 676 to the second end 678.

The first end 670 of the first elongated arm 602 can be affixed, either permanently or removeably, to the first side wall 618, and the second end 672 of the first elongated arm 602 can be affixed, either permanently or removeably, to the second side wall 620. Similarly, the first end 676 of the second elongated arm 604 can be affixed, either permanently or removeably, to the first side wall 618, and the second end 678 of the second elongated arm 604 can be affixed, either permanently or removeably, to the second side wall 620. As illustrated, the first elongated arm 602 and the second elongated arm 604 can cross at a central location 682 to form an "X" pattern between the first side wall 618 and the second side wall 620. A fastener can rotatably affix the first elongated stand 602 to the second elongated arm 604 at location 682.

In an implementation, the first elongated arm 602 and the second elongated arm 604 can be a pair of scissor arms. The pair of scissor arms is located between the first side wall 618 and the second side 620 wall such that the wine rack 610 can pivot between an extended position and a retracted position. In this configuration, the pair of scissor arms are pivotably connected to one another at a central axis 682 located between the respective first and the second ends of the scissor arms.

Figure 15:
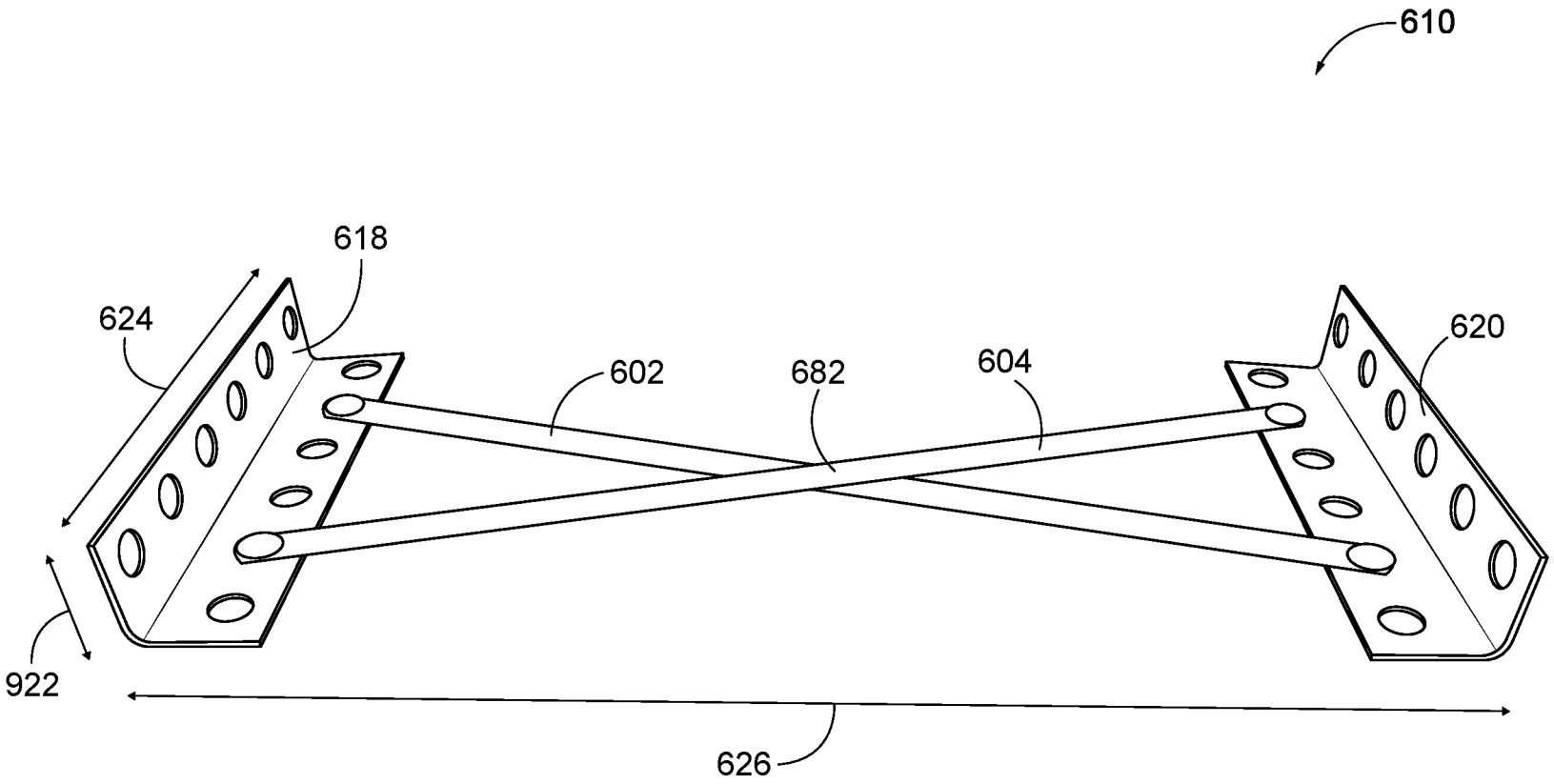
FIG. 15 is a front perspective view of the wine rack.
Figure 16:
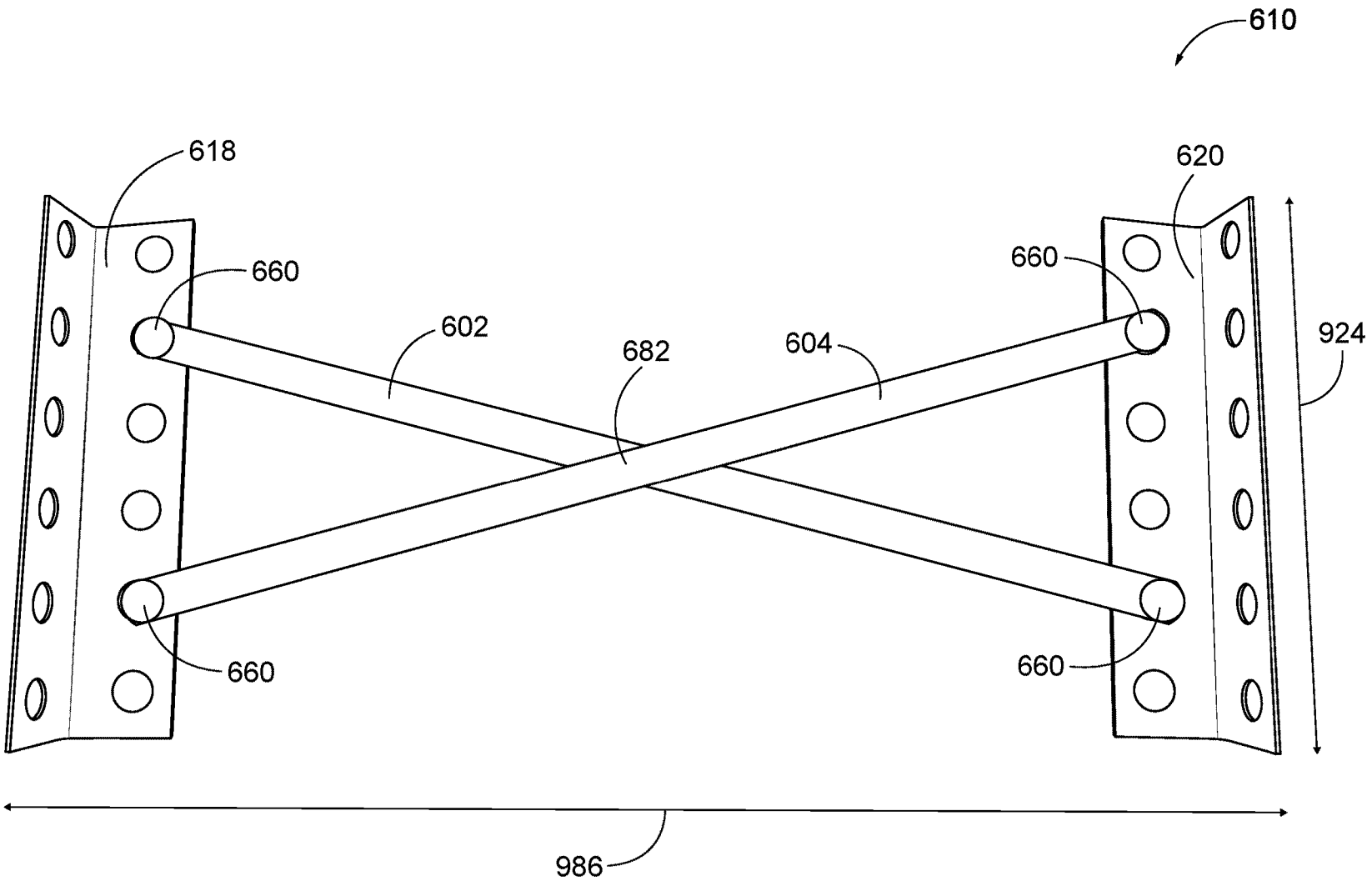
FIG. 16 is a top perspective view of the wine rack.

The wine rack 610 can be configured to have any suitable dimensions. For example, as shown in FIGS. 15 and 16, the wine rack 610 can have a length 626, a width 624, and a height 622. The width 624 of the wine rack 610 can correspond to a width of the first side wall 618 or the second side wall 620. It should be appreciated that the width 624 of the wine rack 610 can be configured to accommodate any suitable container. For example, the width 624 of the wine rack 610 can be a first width to store wine bottles or can be a second width, less than the first width, to store soda cans.

Similarly, the length 626 of the wine rack 610 can be configured to accommodate any number of wine bottles. For example, the length 626 can be increased to accommodate a greater number of wine bottles or the length 626 can be decreased to accommodate less wine bottles. The wine bottles can extend along the width 624 of the wine rack 610 from the first side wall 618 to the second side wall 620. The length 626 can be configured such that there is no gap between the wine bottles to produce a tight fit (e.g., no gap between wine bottles). Alternatively, the length 626 can be configured such that there is a small gap between the wine bottles. A small gap between the wine bottles can allow for greater stability and easier installation or removal of wine bottles. A small gap between bottles can also allow for use with wine bottles of various sizes and diameters. For example, a small gap can allow wine bottles of various diameters to fit between the first and second side walls 618 and 620 without overcrowding.

The one or more elongated arms 602 and 604 can be any suitable length, width, or shape. In the embodiment illustrated in FIGS. 14-19, the elongated arms 602 and 604 can have a rectangular cross section and an elongated length such that the top and bottom of the elongated arms 602 and 604 are substantially flat.

The first elongated arm 602 and the second elongated arm 604 can be connected to and/or affixed to the first side wall 618 and the second side wall 620 in any suitable manner. In this regard, the first elongated arm 602 and the second elongated arm 604 can be either permanently or removeably affixed to the first side wall 618 and the second side wall 620. Additionally, the first elongated arm 602 and the second elongated arm 604 can be configured to rotate and/or swivel in relation to the first side wall 618 and the second side wall 620 to facilitate movement between the elongated arms and the side walls.

By way of example, the first elongated arm 602 and the second elongated arm 604 can be rotatably attached to the first side wall 618 and the second side wall 620 with a fastener 660. The fastener 660 may be any suitable fastener such as, but not limited to, a screw, a bolt, a rivet, a nail, or other similar fastening devices. The fastener 660 extends through an opening in the first elongated arm 602 and a through a corresponding aligned opening in the first side wall 618, such as throughpassage 656, for example. In this manner, the first elongated arm 602 can rotate about the fastener 660 to facilitate a movement of the first elongated arm 602 respective the first side wall 618. It should be appreciated that the second elongated arm 604 can be rotatably attached to the first side wall 618 and/or the second side wall 620 in a similar manner. In one embodiment, the first elongated arm 602 can be rotatably attached to the second elongated arm 604 at the central location 682 using a fastener, such as the fastener 660. Yet in other embodiments, the first elongated arm 602 and the second elongated arm 604 are not rotatable attached at the central location 682.

The wine rack 610 and its corresponding components can be manufactured from any suitable material. By way of example, the first side wall 618, the second side wall 620, the first elongated arm 602, and the second elongated arm 604 can be formed of any suitable material such as, but not limited to, wood, metal, steel, aluminum, plastic, polycarbonate, polyvinyl chloride, polyethylene, polypropylene, carbon fiber, or other similar materials. In an embodiment, the wine rack 610 and its corresponding components are manufactured from a rigid metal material. It should be appreciated, however, that the wine rack 610 and its corresponding components can be manufactured from any suitable material and, in some embodiments, can be manufactured using multiple materials. For example, the first and the second elongated arms 602 and 604 can be manufactured from a first material and the first and the second side walls 618 and 620 can be manufactured from a second material different from the first material.

Similar to the wine rack 10, the various components of the wine rack 610 can be coated with a suitable outer covering such as an epoxy paint primer, such as an all-in-one paint and primer. In some embodiments, the outer covering can be a color of choosing (e.g., red, blue, black, white, etc.). It should be appreciated that the outer covering of the first side wall 618 and the second side wall 620 can be any suitable material such as rubber, plastic, vinyl, or the like. In other embodiments, the first and the second side walls 618, 620 may be free from an outer covering. In these embodiments, the first and second side walls 618, 620 can be finished with a paint, stain, or similar treatments. The first and the second elongated arms 602 and 604 can be coated in a similar manner as described above for the first and the second side walls 616, 620.

In an exemplary embodiment, the wine rack 610 can include gripping features on the bottom of the wine rack 600. The gripping features can engage a surface that the wine rack 610 rests on to ensure that the wine rack 600 is sufficiently held in place on the surface. For example, a gripping feature can be affixed to the bottom surface of both the first and the second side walls 618 and 620 to prevent the wine rack 600 from sliding on a surface. The gripping feature can be manufactured from any suitable material such as rubber to prevent movement or sliding of the wine rack 600 with respect to a surface that the wine rack 600 is resting on.

Figure 17:
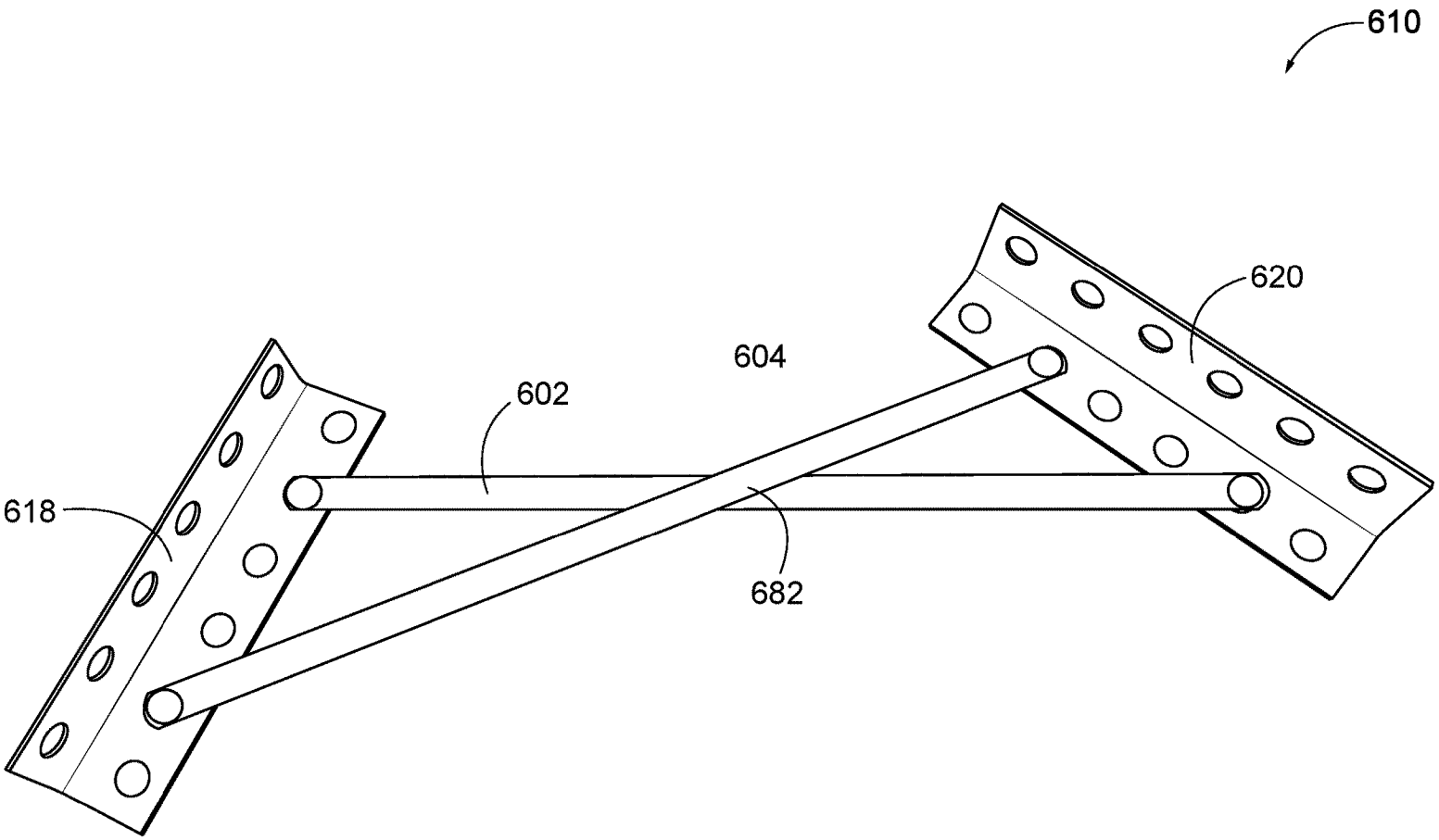
FIG. 17 is perspective view of the wine rack shown in a partially folded configuration.
Figure 18:
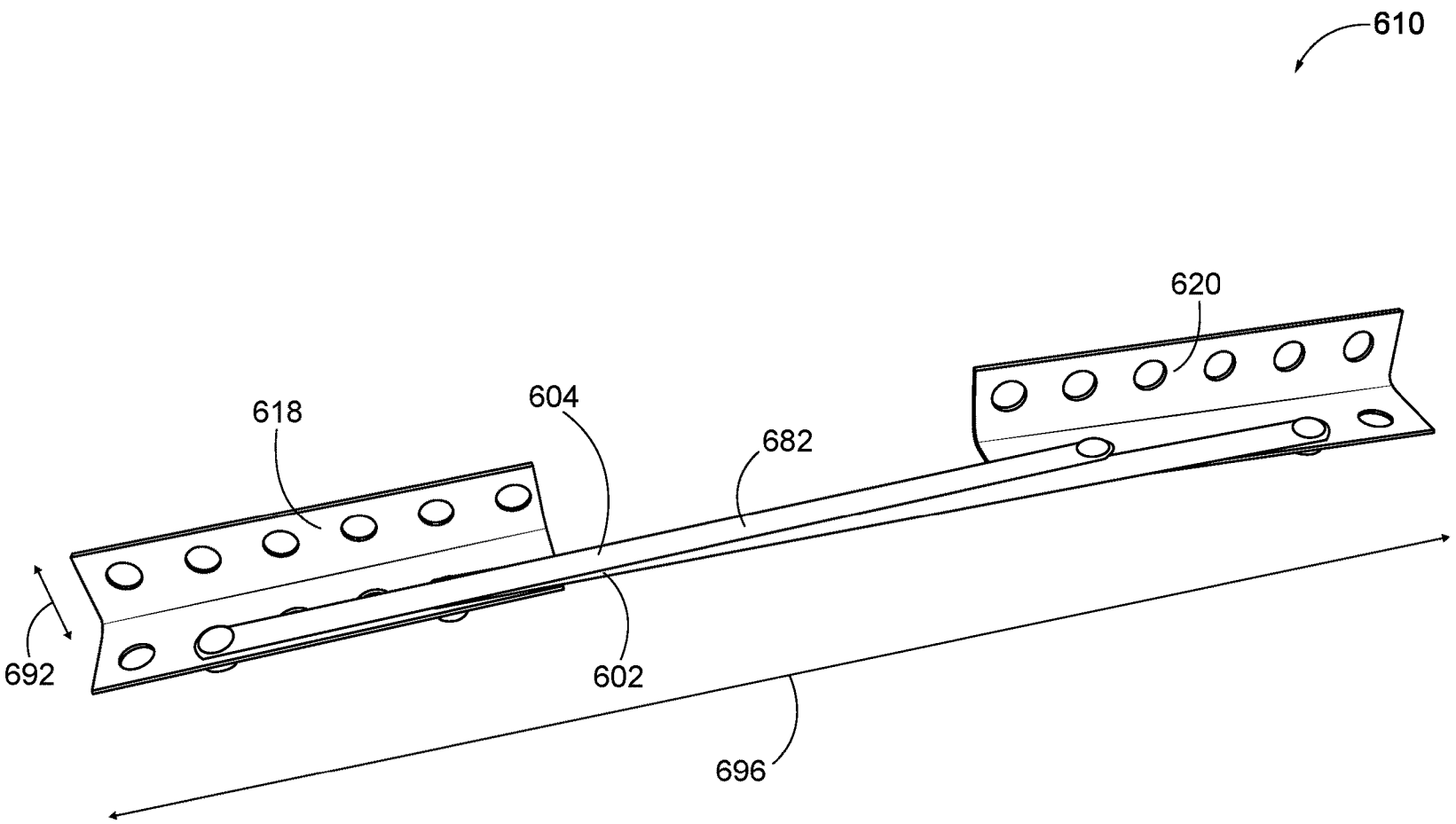
FIG. 18 is a perspective view of the wine rack shown in a fully folded configuration.
Figure 19:
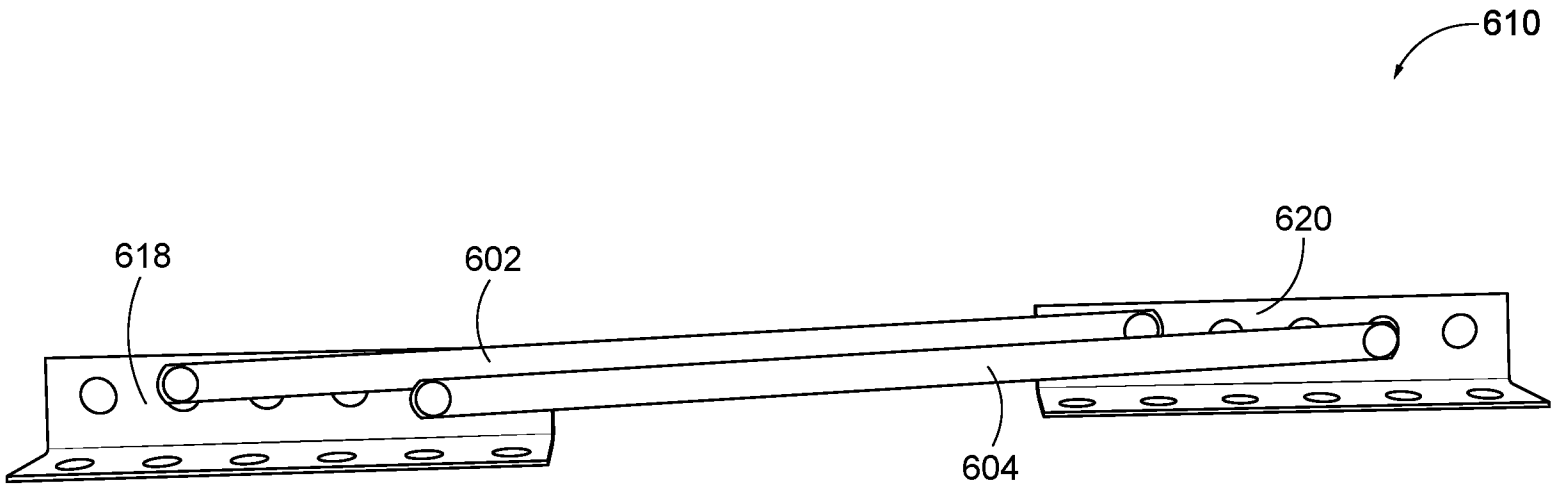
FIG. 19 is a top perspective view of the wine rack shown in a fully folded configuration.

As illustrated in FIGS. 17-19, the wine rack 600 can fold into a stowed (or retracted) position for easy storage or transportation. It should be appreciated that the first and second elongated arms 602 and 604, when rotatably affixed to the first and second side walls 618 and 620, can allow the wine rack 610 to fold into the stowed position. FIG. 17 illustrates the wine rack 610 in a partially folded or partially stowed configuration. In the partially folded configuration, the first and the second side walls 618 and 620 are no longer parallel to one another. In the fully folded or fully stowed position, illustrated in FIGS. 18 and 19, the first and the second side walls 618 and 620 are substantially parallel to and in line with one another. Additionally, the first and the second elongated arms 602 and 604 are substantially parallel to one another in the fully folded or fully stowed configuration.

In the fully folded or fully stowed configuration, the wine rack 610 can have different dimensions compared to the wine rack 610 in the extended configuration (e.g., FIGS. 14-16). For example, the wine rack 610 in the stowed configuration can have a length 696, a width 694, and a height 692. The length 696 can be greater than the length 626 of the extended configuration, but the width 694 can be less than the width 624 of the extended configuration. In this manner, the wine rack 610 can be longer and narrower than the wine rack in the extended position thereby allowing for easy stowage of the wine rack 610.

One will notice that in the extended position (illustrated in FIG. 14), the distance between the first side wall 618 and the second side wall 620 is greater than the distance between the first side wall 618 and the second side wall 620 in the fully retracted position (illustrated in FIGS. 18 and 19). Further, in the extended position (illustrated in FIG. 14), the first side wall 618 and the second side wall 620 are substantially parallel to one another. In the fully retracted position (illustrated in FIGS. 18 and 19), the first side wall 618 and the second side wall 620 are both substantially parallel to one another and co-linear.

It is to be understood that the wine racks 10, 100, 300, 400, 500, and 600 may be applicable to other suitable uses, and, in those situations, can be referred to as a container rack 10, 100, 300, 400, 500, or 600. Other suitable uses for the container rack 10, 100, 300, 400, or 500 can include storing soda cans, beer bottles, food cans, or the like. It should be appreciated that the container rack 10, 100, 300, 400, 500, or 600 can be configured to support any container, can, bottle, or similar object without deviating from the scope of this application.

Further, although certain embodiments have been shown and described, it is understood that equivalents and modifications falling within the scope of the appended claims will occur to others who are skilled in the art upon the reading and understanding of this specification.

What is claimed is:

1. A rack for supporting a plurality of cylindrical containers, the rack comprising:

a mat formed from a flexible material and having a first end and a second end;

a first elongate side wall having a first end and a second end, the first elongate side wall being affixed to the first end of the mat along a width of the mat, the first elongate side wall including a cove extending along a length of the first elongate side wall from the first end to the second end, the cove comprising a radius; and a second elongate side wall having a first end and a second end, the second elongate side wall being affixed to the second end of the mat along the width of the mat, the second elongate side wall including a cove extending along a length of the second elongate side wall from the first end to the second end, the cove comprising a radius, wherein the rack is configured to support a plurality of cylindrical containers on a top of the mat between the cove of the first elongate side wall and the cove of the second elongate side wall, the radius of each of the coves of the first elongate side and the second elongate side corresponding to a radius of at least one of the cylindrical containers.

2. The rack of claim 1, wherein the rack is configured to be rolled into a stowed position and unrolled into an unstowed position.

3. The rack of claim 2, wherein the rack further comprises a strap configured to hold the rack in the stowed position.

4. The rack of claim 1, wherein each elongate side wall has a base portion extending along a width of each elongate side wall and being affixed to the mat, a support portion extending upward from the base portion along a height of each elongate side wall, the cove extending along the length of each elongate side wall from a top of the support portion towards the base portion.

5. The rack of claim 1, wherein the mat is manufactured from polychloroprene.

6. The rack of claim 1, wherein the first and the second elongate side walls are coated with epoxy paint primer.

7. The rack of claim 1, in combination with a cylindrical container, the cylindrical container being a wine bottle, and wherein the rack is configured to be wrapped around a circumference of the wine bottle for storage or transportation of the rack with the cylindrical container.

8. A rack for supporting a plurality of cylindrical containers, the rack comprising:

a mat formed from a flexible material and having a first end and a second end;

a first elongate side wall having a first end, a second end, and a cove extending along a length of the first elongate side wall from the first end to the second end, the first elongate side wall being affixed to a top of the mat at the first end of the mat along a width of the mat; and a second elongate side wall having a first end, a second end, and a cove extending along a length of the second elongate side wall from the first end to the second end, the second elongate side wall being affixed to the top of the mat at the second end of the mat along the width of the mat, wherein, the first elongate side wall and the second elongate side wall are affixed to the mat with a plurality of fasteners extending through the mat in a direction from a bottom of the mat to the top of the mat such that the plurality of fasteners extend into each elongate side wall to affix each elongate side wall to the mat, wherein the rack is configured to support a plurality of cylindrical containers on the top of the mat between the first elongate side wall and the second elongate side wall, and wherein the rack is configured to be rolled into a stowed position and unrolled into an un-stowed position.

9. The rack of claim 8, wherein the cove of the first elongate side wall and the cove of the second elongate side wall each comprise a radius, the radius of the coves correspond to a radius of at least one of the cylindrical containers.

10. The rack of claim 9, wherein the rack is configured to support a plurality of wine bottles on top of the mat between the cove of the first side wall and the cove of the second side wall.

11. The rack of claim 4, wherein the base portion of each of the elongate side walls is affixed to a top of the mat with at least one fastener.

12. The rack of claim 11, wherein each of the at least one fastener extends through a bottom of the mat to the top of the mat and into the base portion of the first elongate side wall or the second elongate side wall.

13. The rack of claim 1, further comprising a distance between the cove of the first elongate side wall and the cove of the second elongate side wall, wherein the distance between the coves is configured according to a diameter of the plurality of cylindrical containers such that a first portion of the plurality of cylindrical containers can be supported between the coves of each of the elongate sides leaving a slight gap between the cylindrical containers to allow for installation and removal of the cylindrical containers.

14. The rack of claim 8, further comprising a distance between the cove of the first elongate side wall and the cove of the second elongate side wall, wherein the distance between the coves is configured according to a diameter of the plurality of cylindrical containers such that a first portion of the plurality of cylindrical containers can be supported between the coves of each of the elongate sides leaving a slight gap between the cylindrical containers to allow for installation and removal of the cylindrical containers.

15. The rack of claim 5, wherein each of the elongate side walls are manufactured from a material that is more rigid than the polychloroprene mat.

16. The rack of claim 5, wherein the elongate side walls are manufactured from a rigid material.

17. The rack of claim 5, wherein the elongate side walls are manufactured from wood.

18. The rack of claim 16, wherein the elongate side walls are coated with epoxy paint primer.

* * * * *